US007637854B2

(12) United States Patent
Jang

(10) Patent No.: US 7,637,854 B2
(45) Date of Patent: Dec. 29, 2009

(54) BACKBONE CORRECTION EXERCISE APPARATUS

(76) Inventor: Suk Hwan Jang, 101-1005, Doojin Baekno APT. 985, Cheongjeon-dong, Jecheon-si, Chungcheongbuk-do (KR) 390-769

( * ) Notice: Subject to any disclaimer, the term of this patent is extended or adjusted under 35 U.S.C. 154(b) by 0 days.

(21) Appl. No.: 11/938,361

(22) Filed: Nov. 12, 2007

(65) Prior Publication Data

US 2008/0113853 A1 May 15, 2008

(30) Foreign Application Priority Data

Nov. 13, 2006 (KR) ..... 10-2006-0111649

(51) Int. Cl.
*A63B 26/00* (2006.01)

(52) U.S. Cl. ..... 482/142; 482/148

(58) Field of Classification Search ..... 482/142, 482/148, 52–54

See application file for complete search history.

(56) References Cited

U.S. PATENT DOCUMENTS 5,601,519 A * 2/1997 Comereski ..... 482/142
6,962,554 B2 * 11/2005 Keiser ..... 482/112

* cited by examiner

*Primary Examiner*—Lori Amerson
(74) *Attorney, Agent, or Firm*—Ladas & Parry LLP

(57) ABSTRACT

A backbone correction exercise apparatus is provided, in which a user lies on a bed and wears a pelvis belt, adjusts distance from an exercise unit depending on a user's physical condition, and then perform recursive exercises, to thereby slack and restore the cervical vertebra portion and the lumbar vertebra portion of the human body repeatedly and to thus strengthen spinal peripheral support muscles in order to provide a spinal curative effect as well as a spinal exercise effect, and which includes and exercise unit which enables a user to lie on a bed and take an exercise using the user's feet, and a pelvis belt whose intermediate portion is fixed to the bed on which the user lies and whose side extensions extended from the intermediate portion rise up from the bed and wrap and hold a portion corresponding to the waist of the user with a binding unit which is provided in the ends of the extensions.

12 Claims, 14 Drawing Sheets

BACKBONE CORRECTION EXERCISE APPARATUS

CROSS-REFERENCE TO RELATED APPLICATIONS

This application claims the benefit of Korean Patent Application No. 10-2006-0111649, filed on Nov. 13, 2006 (now registered as Registration Patent No. 10-0711104 on Apr. 18, 2007), in the Korean Intellectual Property Office, the disclosure of which is incorporated herein by reference.

BACKGROUND OF THE INVENTION

1. Field of the Invention

The present invention relates to an exercise apparatus for correcting and strengthening the backbone, and more particularly, to a backbone correction exercise apparatus, in which a user lies on a bed and wears a pelvis belt, adjusts distance from an exercise unit depending on a user's physical condition, and then performs recursive exercises, to thereby slack and restore the cervical vertebra portion and the lumbar vertebra portion of the human body repeatedly and to thus strengthen spinal peripheral support muscles in order to provide a spinal curative effect as well as a spinal exercise effect.

2. Description of the Related Art

It is inevitably inescapable that a big load is applied to the backbone of a human being who takes a walk in an erect posture. In particular, scoliosis may be caused by bad habits in modern person's complex life, to thus appeal pain of the waist.

Usually, there is a somewhat difference between the lengths of the left and right legs according to the physical structure or life habit of the respective individuals in everyday life. On this account, the pelvis is wrung to thus cause lumbago and hip-gout. The extreme case is that the backbone secedes from its position, to thus slip intervertebral disks.

One of diseases which frequently occur at recent times to modern persons is a slip of a disk. This disk slip may occur more seriously due to an underexercise and a long-time sitting life style of modern persons.

A slip of a disk is a disease which oppresses nerve and causes pain since a lumbar interval is pressed down and narrowed or a wheel of a disk is deformed, to thus make the spinal cord come out. The best method of curing this disk disease is to widen the narrowed lumbar interval and strengthen the peripheral muscle to thus make the come-out spinal cord positioned it its place. In this way, if the escaped spinal cord is located in its place, symptoms disappear and the disk disease is cured by a nature healing power of the human body.

Therefore, a treatment method of widening a lumbar interval through a physiotherapy curer and strengthening surrounding muscle is usually used at the time of occurrence of a disease of disks.

However, such a physiotherapy curer is a very expensive product, and excessive medical fees are required for curing the disk disease. General users would give up treatment of the disk disease. On this account, an intervertebral disk disease is too worsened for a disk patient to control the body.

Up to now, there are no relatively inexpensive and effective treatment apparatus for curing the disk disease. Thus, the disk patients depend on drugs or put off fundamental treatments until they find hospital. As a result, an untimely treatment may cause to deepen spinal transformation and pain.

Also, even in the case of displacement of the cervical vertebrae which is called a neck bone disk like the lumbar displacement, it is uncomfortable and inconvenient for patients to undergo a long-time orthodontic therapy at hospital through a physiotherapy curer. Because of such an uncomfortable and inconvenient situation, they may rely on a short time medical treatment about a damaged region. In this case, the neck bone disk is also apt to advance to a chronic disease which cannot be easily treated at hospital.

The physiotherapy curer for curing the cervical vertebrae is a device that artificially stretches the damaged cervical vertebral portion of the human body and restores the function of the damaged cervical vertebral portion. A retractor which ordinarily applies a physical force to the cervical vertebral portion to repeat a relaxation and recovery process is used as the physiotherapy curer. This retractor is configured to have a bed unit which supports the human body and a head unit which fixedly supports the head portion. The head unit is repeated to move forward or reward by an artificial and coercive force which is applied from the outside in the backbone direction, to thereby make the cervical vertebrae pulled or retracted.

However, such a conventional retractor is hard to be installed and used on a general bed. In addition, other joints (such as leg joints) should be fixed at orthodontic therapy. As a result, the other joints may be damaged. Further, the conventional retractor does not have a traction unit which is appropriate for relaxing and recovering the cervical vertebrae by a constant force. As a result, in the case that an unreasonable force is applied to a patient, he or she may feel considerable pain, and an impact on the cervical vertebral portion may exasperate symptoms. Such simple traction of the cervical vertebral portion may cause sturdiness of muscles.

Meanwhile, a ceaseless exercise medical treatment is necessary to prevent or take a favorable turn the backbone disease. According to such a necessity, an exercise unit that can strengthen the backbone support muscles has been developed and used, but such a conventional exercise unit should let patients make an exercise in a sitting posture style. As a result, since the patients may be frequently injured and suffer from increased pain during making an exercise, it is difficult to make a continuous exercise to thereby have difficulty in obtaining an exercise effect and a curative effect.

SUMMARY OF THE INVENTION

To overcome inconveniences of the conventional art, it is an object of the present invention to provide a backbone correction exercise apparatus, in which a user lies on a bed and wears a pelvis belt, adjusts distance from an exercise unit depending on a user's physical condition, and then binds the user's waist with the pelvis belt to perform recursive exercises, to thereby slack and restore the cervical vertebra portion and the lumbar vertebra portion of the human body repeatedly and to thus strengthen spinal peripheral support muscles in order to provide a spinal curative effect as well as a spinal exercise effect.

It is another object of the present invention to provide a backbone correction exercise apparatus which is easily installed in sports facilities, hospitals or homes and is efficiently used by a relative simple composition and direction of use, to thereby correct position of the pelvis and to thus solve a cause that may lead to backbone pain as well as to cure a chronical lumbago, gout by a slip of a disk and other backbone diseases.

To accomplish the above object of the present invention, there is provided a backbone correction exercise apparatus comprising: an exercise unit which enables a user to lie on a bed and to take an exercise using the user's feet; a pelvis belt which is fixed to the bed on which the user lies and a portion corresponding to the waist of the user who lies on the bed, and which holds the user's waist to then be fixed to the bed; and a bed unit along which the bed moves so that the bed unit is combined with the exercise unit and distance between the exercise unit and the user is controlled, wherein the intermediate portion of the pelvis belt is fixed to the bed, and both side extensions from the intermediate portion of the pelvis belt rise up from the bed and wrap the user's waist, and wherein a binding unit which binds the ends of the extensions is provided in the ends of the extensions.

There is also provided a backbone correction exercise apparatus comprising: an exercise unit which enables a user to lie on a bed and to take an exercise using the user's feet; a bed unit which comprises: a fixed frame combined with the exercise unit; a movable frame slidably combined on the fixed frame; the bed fixed on the movable frame; and a pelvis belt which is fixed to a portion corresponding to the waist of the user who lies on the bed, and which holds the user's waist to then be fixed to the bed, in which the bed moves along the bed unit so that distance between the exercise unit and the user is controlled; and a positioning unit which is installed in the fixed frame and the movable frame and which allows the movable frame to move or to be maintained at the moved state, wherein the intermediate portion of the pelvis belt is fixed to the bed, and both side extensions from the intermediate portion of the pelvis belt rise up from the bed and wrap the user's waist, and wherein a binding unit which binds the ends of the extensions is provided in the ends of the extensions.

As human beings live an erect life, they may more frequently suffer from backbone diseases than other animals. The erect life provides an advantage of allowing human beings to use hands, but provides a shortcoming of causing most of the human beings to suffer from backbone diseases once or more in their lives. Further, since there are many people employed in the secondary and tertiary industries according to sudden industrialization and automation at modern times, and the primary industry is also mechanized, population who does physical labor than in the past decreases remarkably. Accordingly, parts that support the human's backbone at the modern times, for example, support muscles and ligaments are gradually weakened.

According to data of the Self-generation Backbone Research Institute, it has been reported that about 30% of backbone disease patients who have been treated in the Self-generation Korean Medicine Hospital are white-collar workers who sit for long hours and suffer from the lumbago without external injury or especial allurement. Further, it has been reported that about 40% of lumbago patients are found from people who repeat bending and spreading their waists in an identical action even with a lot of activities.

Actually, most causes that lead to lumbar sprain or distortion at a sickbed are derived from a juncture that lumbar peripheral support muscles are latent at a weak state. People may hurt the waists extremely even at a small action of lifting light goods by such dormant causes. For example, an intervertebral disk may be frequently slipped during performing a light action such as a face or hand washing action which is performed after having bent the waist simply.

Accordingly, the support muscles surrounding the waist, that is, the rotator, the anterior cruciate ligament, the posterior cruciate ligament, the cruciate ligament, the suspensory ligament, and other various kinds of ligaments need to be treated as a strengthening exercise, in view of prevention and treatment dimensions. When such a strengthening exercise has been executed properly, it may become a very strong medical treatment and prevention unit. Specially, the support muscles in the periphery of a disk (the anterior cruciate ligament and the posterior cruciate ligament) play a role of holding in check fluidity of a disk (i. e. a natural response to expand to the outside of the disk) and protecting the disk from being damaged. The support muscles in the periphery of a disk is very important in view of a backbone health. As an example, since disk bulging is chiefly caused by a weakness relaxation symptom of the anterior cruciate ligament and the posterior cruciate ligament, the backbone support muscles should be strengthened in order to treat the disk bulging. The strengthening exercise for the backbone support muscles is the most effective exercise for a lumbar strengthening exercise which can cure disk collision symptoms, idiopathic scoliosis, acute lumbar cervical vertebrae sprain or distortion, and chronic low back pain. In this case, if isometrics (isometric exercises) are executed, a very fast pain decrease effect exists, and an effect of increasingly reinforcing activities appears immediately.

Generally, a cycling exercise is prevalent as a very good exercise having various kinds of effects of a muscular exercise, a cardiopulmonary exercise, and a nether limbs strengthening exercise, but it is very difficult for disk patients or patients who suffer from waist pain or lumbago to do exercise because of pain caused by pressing nerves. The cycling is a representative exercise for people to do exercise in a sitting posture. Accordingly, because backbone is pressed down in a sitting posture, disk patients or lumbago patients suffer from much more pain. This invention provides an exercise apparatus that is designed to allow disk or lumbago patients to lie down and conveniently make an exercise with an exercise unit such as a cycling machine or a stepper that exhibits an exercise effect similar to the cycling machine. Specially, a pelvis belt is provided in a bed unit to make the patient's waist fixed to the pelvis belt. The patient makes an exercise while making the exercise unit with the patient's feet at the state where the patient's waist has been fixed to the pelvis belt. As a result, backbone is pulled and restored from the pelvis according to the exercise, to thereby provide a backbone traction effect. In addition, a bed is moved on a fixed frame of the exercise unit and distance is adjusted between the exercise unit and the patient. That is, the exercise apparatus is designed so that distance between the exercise unit and the patient can be controlled at a proper position according to a patient's physical condition. Furthermore, backbone gets unfolded by a reaction during making an exercise, and thus the upper half of the body on the pelvis moves up. The bed has a sliding movement structure so that the bed can move within a certain interval according to such an upward movement of the upper half of the body. Accordingly, the exercise device according to the present invention doubles an exercise effect to thus enhance a backbone correction capability. The pelvis belt plays a role of assisting a recovery of the lumbar vertebra by pressing the patient's lumbar at a state where a patient has lain down on the bed in addition to a function of fixing the pelvis to the bed.

BRIEF DESCRIPTION OF THE DRAWINGS

The above and/or other aspects of the present invention will become apparent and more readily appreciated from the following description of the exemplary embodiments, taken in conjunction with the accompanying drawings in which.

DETAILED DESCRIPTION OF THE INVENTION

Figure 1:
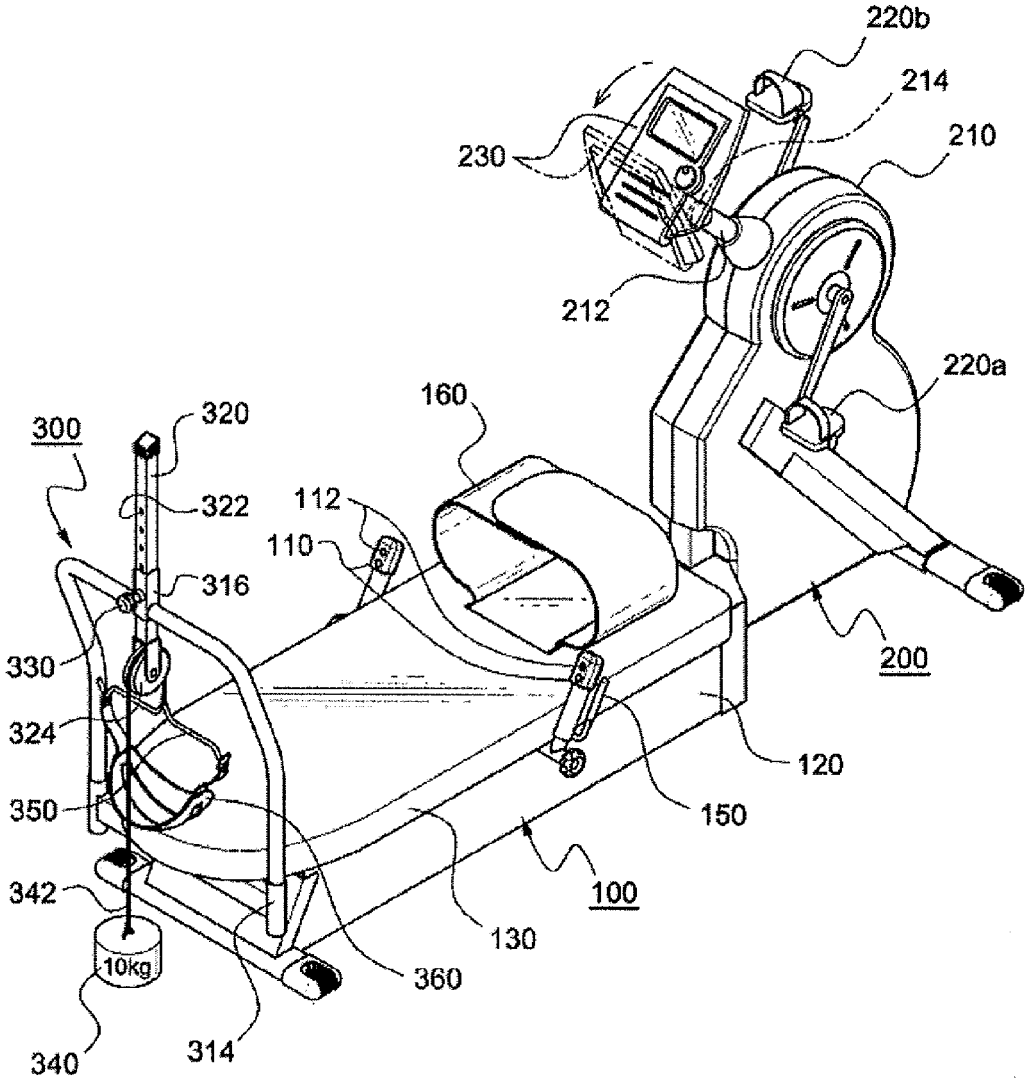
FIG. 1 is a perspective view showing an assembled backbone correction exercise apparatus according to the present invention.

Reference will now be made in detail to exemplary embodiments of the present invention, examples of which are illustrated in the accompanying drawings, wherein like reference numerals refer to like elements throughout. The embodiments are described below in order to explain the present invention by referring to the figures.

Hereinbelow, a backbone correction exercise apparatus according to a preferred embodiment of the present invention will be described with reference to the accompanying drawings. Like reference numerals are assigned for like elements in the drawings.

Figure 2:
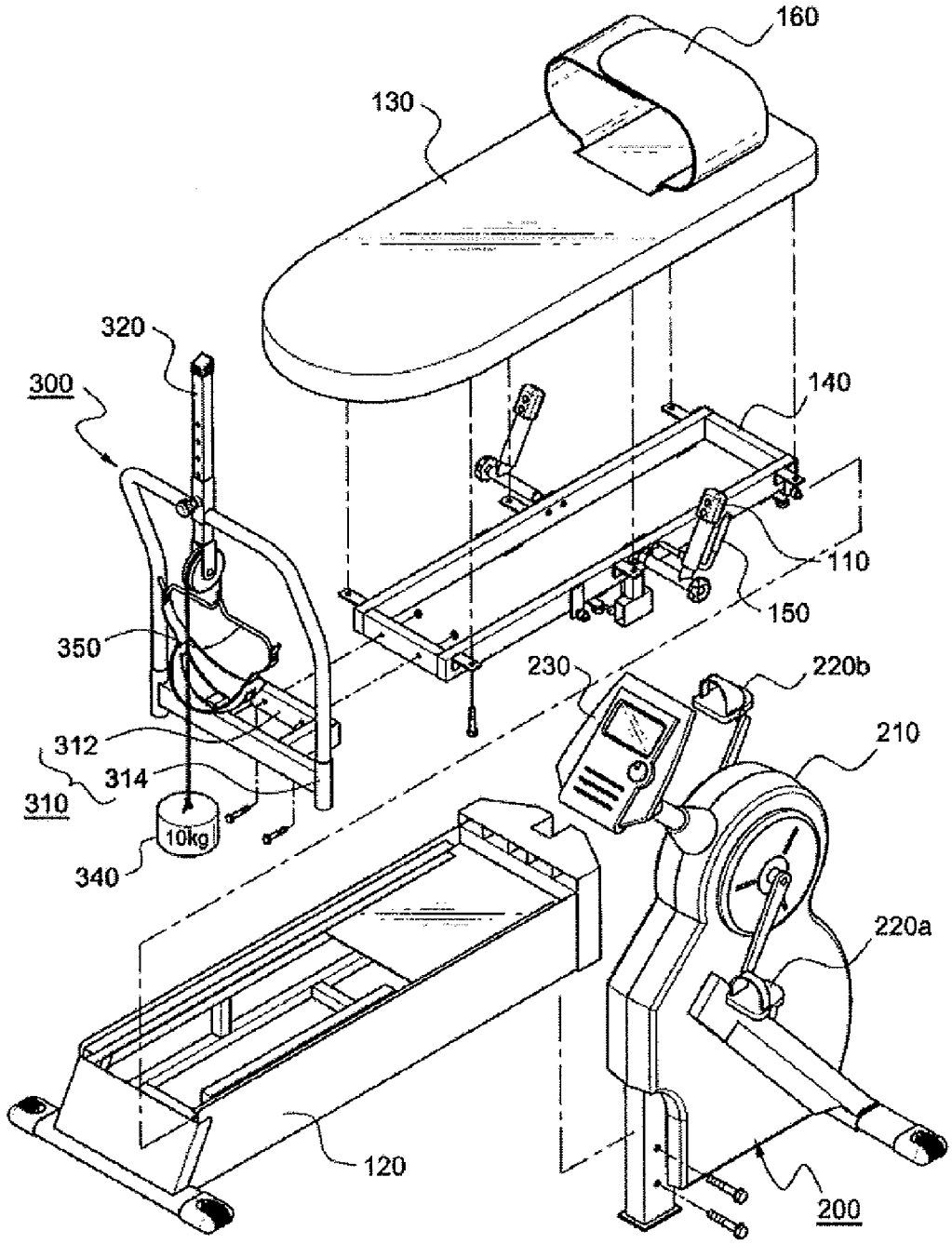
FIG. 2 is an exploded perspective view of FIG. 1.
Figure 3:
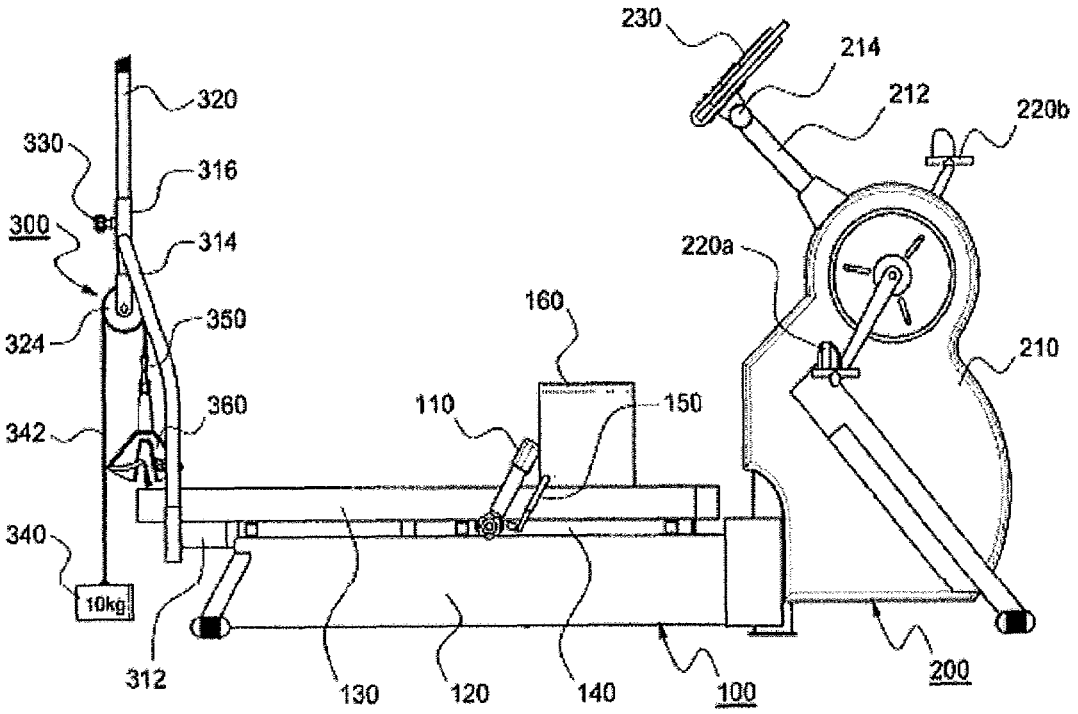
FIG. 3 is a side view of FIG. 1.

FIG. 1 is a perspective view showing an assembled backbone correction exercise apparatus according to the present invention. FIG. 2 is an exploded perspective view of FIG. 1. FIG. 3 is a side view of FIG. 1.

As illustrated, the backbone correction exercise apparatus according to the present invention includes a bed unit 100 on which a user lies down to make an exercise, and an exercise unit 200 such as a cycling machine, and a stepper which is linked with the bed unit 100 and allows the user who lies down on the bed unit to make an exercise using the user's feet. In addition, all kinds of appropriate exercise units which allow a user to lie down and make an exercise using the feet may be used as the exercise unit 200. In this embodiment, a cycling machine is applied as the exercise unit 200.

The exercise unit 200 is linked on the bottom of the bed unit 100 and is located at the leg sides when a user lies down on the bed unit 100. The exercise unit 200 includes a pair of pedals 220*a* and 220*b* into which both feet of the user are safely fitted from both sides of a body 210 of the exercise unit 200. A display panel 230 whose angle can be adjusted is provided toward the bed unit 100 on the upper portion of the body 210 of the exercise unit 200. Concretely, the displays panel 230 is combined by a joint 214 on the end portion of a support 212 slantingly extending forward to the bed unit 100 from the body 210. Accordingly, the displays panel 230 is angularly adjusted. Therefore, a user turns the display panel 230 to an angular position which is visible well at a state where the user lies down on the bed unit 100 to then use the display panel 230. The user can confirm exercise conditions such as an exercise kind, strength, rate, and calorie consumption, through the display panel 230. Setting of these exercise conditions can be directly performed on the display panel 230. However, since a user who lies down to make an exercise should get up from the bed unit in the case that setting of these exercise conditions is directly performed on the display panel 230, the exercise apparatus according to the present invention is equipped with a remote controller 110 that can allow the user to control all the exercise conditions at the state where the user has lain down. The remote controller 110 is provided at a position to which a user can gain easily access by the hand or hands of the user who lie down on the bed unit 100. For this, in this embodiment, the remote controller 110 is implemented into a pair of handles which are protruded from both sides of the bed unit 100 and are located at a position of a height where a user lies down to then easily gain access to the remote controller 110 by the hand. Control buttons 112 are provided toward the head of the user who lies down on the bed unit 100. The remote controller 110 having the above-described composition is linked with the display panel 230 so as to send and receive signals by radio or wire.

Meanwhile, the bed unit 100 includes a bed 130 which is installed on the fixed frame 120 which is combined with the exercise unit 200, so that distance with respect to the exercise unit 200 may be adjusted according to the user's physical conditions, fox example, height, length of the leg, etc. A positioning unit is provided in the bed unit 100. By the positioning unit, a movable frame 140 is combined on the fixed frame 120, and is horizontally moved on the fixed frame 120 so that the movable frame 140 gets close to or far from the exercise unit 200. Finally, the movable frame 140 is fixed at a position where the movable frame 140 has been controlled. The bed 130 is combined by bolts, screws or adhesives on the movable frame 140, and moves integrally together with the movable frame 140. Through the positioning unit, the user manipulates a position control lever 150 that projects at the side of the bed unit 100 and releases the fixed state of the movable frame 140. Accordingly, the movable frame is allowed to move on the fixed frame 120. At this state, the user pushes the bed 130 to move to an appropriate position which is favorable to the user. Thereafter, the bed 130 is again converted into a fixed state through the position control lever 150, to thus make the movable frame 140 kept at the moved state. As described above, the detailed structure of the positioning unit which is used to control position of the bed 130 will be described in detail with reference to FIGS. 8 to 11.

A pelvis belt 160 is provided in the bed 130, which holds the user's waist of the user who lies down on the bed 130, concretely, the pelvis of the user and makes the held pelvis fixed to the bed 130. Both side ends of the pelvis belt 160 are withdrawn from the bed 130 like a pair of wings at a position equivalent to the user's waist in the bed 130, and are combined with each other while wrapping the user's waist. The pelvis belt 160 is combined directly with the bed 130, using bolts, screws, adhesives, etc., as a coupling element. Preferably, the pelvis belt 160 is configured into a structure of tightening the user's waist. As a result, backbone is pressed to thus provide an accompanying effect of making the backbone pulled and reduced. The composition of the pelvis belt 160 and the coupling structure between the pelvis belt 160 and the bed 130 will be described below in detail with reference to FIGS. 4 and 5.

Meanwhile, in addition to the above-described coupling structure of the exercise unit 200 and the pelvis belt 160 to tow away the lumbar, the cervical vertebrae traction unit 300 which is worn the user's head to tow away the cervical vertebrae can be combined with the upper end portion of the bed unit 100 (corresponding to the user's head side when the user lies down on the bed). The cervical vertebrae traction unit 300 includes a mount portion 310 which is vertically fixed to the movable frame 140 at the head side of the movable frame 140. The cervical vertebrae traction unit 300 includes a lower combiner 312 that is coupled by bolts, screws, etc., at the head side of the movable frame 140, and a vertical rod portion 314 which is vertically formed at both ends of the lower combiner 312 and in a substantially rectangular shape. A holder 316 is provided in the middle of the upper end of the vertical rod portion 314. A vertical movable rod 320 penetrates through the holder 316 to control height. That is, the vertical movable rod 320 is a rectangular rod, and height control holes 322 are formed at certain intervals in the height direction along the vertical movable rod 320. A height control rod 330 is provided on the surface of the holder 316 in correspondence to the vertical movable rod 320. The height control rod 330 is released out and then the vertical movable rod 320 is set to a desired height. then, the height control rod 330 is fitted into and locked up the height control holes 322 to then be fixedly positioned at the controlled position of the height control holes 322. A pulley 324 is attached on the lower end of the vertical movable rod 320, and a weight (a load) 340 to tow away the cervical vertebrae is suspended to a cervical vertebrae traction bar 350 by a rope 342 through the pulley 324. Then, the user puts on a traction portion 360 on his or her head at the state where the user lies down on the bed, to then fix the traction portion 360 to both ends of the cervical vertebrae traction bar 360. In this case, a force of pulling the head is produced by the load of the weight 340 to thus tow away the lumbar. The above-described rectangular vertical rod portion 314 is preferably bent outwards as shown in the drawings, so that the upper portion of the vertical rod portion 314 gets far from the bed 130 at an approximately middle portion of the vertical rod portion 314, in order to prevent the weight 340 from colliding with the lower structure of the cervical vertebrae traction unit 300, according to the ascending and descending of the weight 340.

Figure 4:
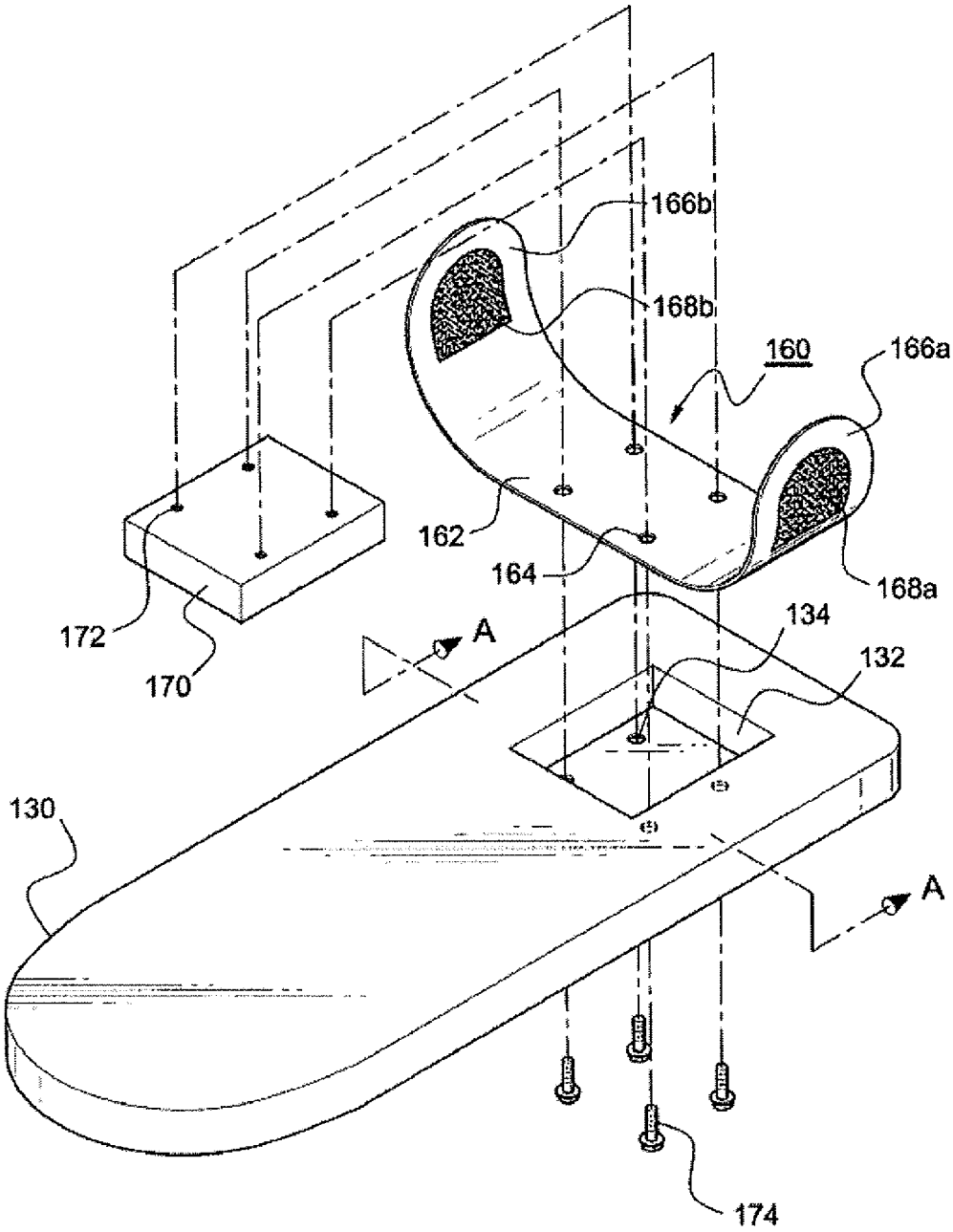
FIG. 4 is a partly extracted perspective view showing structure of a bed in detail according to the present invention.
Figure 5:
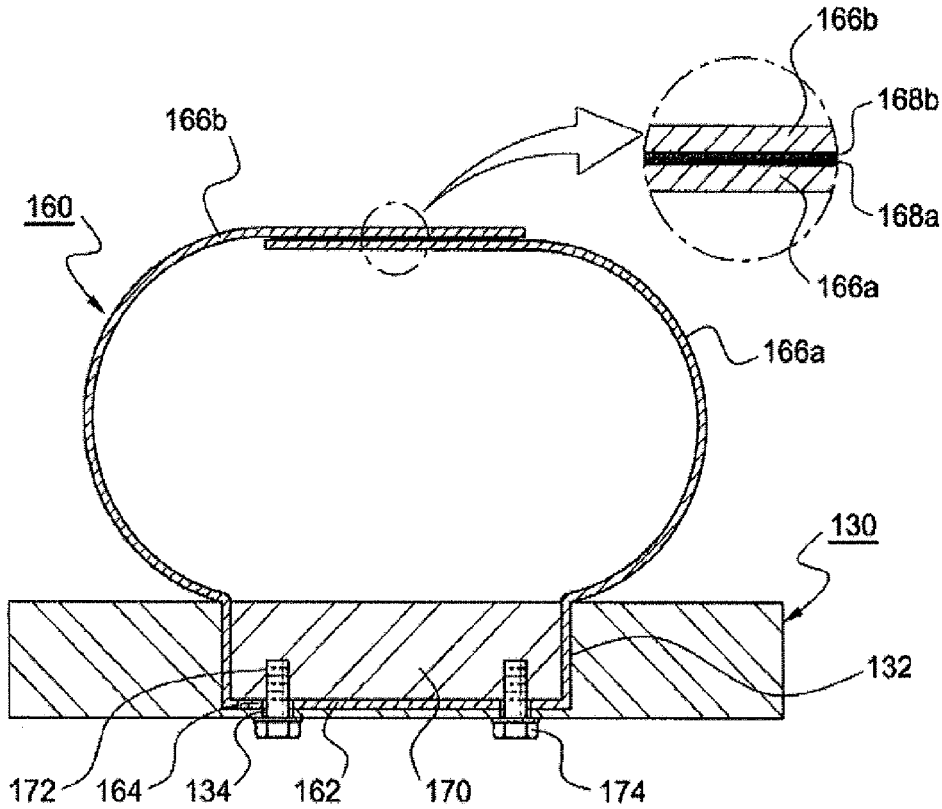
FIG. 5 is a cross-sectional view showing a combined structure of a belt combined on the bed illustrated in FIG. 4.

FIG. 4 is a partly extracted perspective view showing structure of a bed in detail according to the present invention. FIG. 5 is a cross-sectional view showing a combined structure of a belt combined on the bed cut along a line A-A illustrated in FIG. 4.

The bed 130 contains cushion therein to give comfort to users, and the surface of the bed 130 is preferably enclosed by leather, synthetic leather etc.

The bed 130 is combined with a pelvis belt 160 at a position corresponding to a waist portion of a user who lies down on the bed 130, more accurately, the user's pelvis. Accordingly, a belt installation groove 132 is provided on the bed 130 at a position where the user's pelvis is located. Bolt holes 134 are drilled in and at the belt installation groove 132.

The intermediate portion of the pelvis belt 160 is entered into and located in the belt installation groove 132. Piercing holes 164 are drilled at positions corresponding to the bolt holes 134 in the middle portion 162 of the entered pelvis belt 160. The middle portion 162 of the pelvis belt 160 is entered into and received into the belt installation groove 132 of the bed 130.

Both side extensions 166*a* and 166*b* that are extended to both sides of the intermediate portion 162 thereof are exposed to the top surface of the bed 130. Both the side extensions 166*a* and 166*b* of the exposed pelvis belt 160 wrap the user's waist. In this case, both ends of the pelvis belt 160 are combined with each other. For this, hook and loop fasteners (namely a sticker) 168*a* and 168*b* such as VELCRO™ fasteners are provided at contact portions facing each other in the periphery portion of the ends of both the side extensions 166*a* and 166*b* of the pelvis belt 160. Female and male portions of the hook and loop fasteners 168*a* and 168*b* are fixed to both the side extensions 166*a* and 166*b* of the pelvis belt 160, one by one, respectively. Such female and male portions of the hook and loop fasteners 168*a* and 168*b* are attached to each other. Accordingly, both ends of the pelvis belt 160 are combined together. The hook and loop fasteners 168*a* and 168*b* are preferably used as a binding unit of the pelvis belt 160. However, besides, a belt at one side of which a locker is formed and at the other side of which locking holes are formed so that the locker enters into one of the locking holes may be used as the binding unit of the pelvis belt 160. Otherwise, a mechanism of an automatic combining unit of a belt may be employed as the binding unit of the pelvis belt 160. Simply, the binding unit of the pelvis belt 160 may be implemented in the form of a snap fastener.

At the state where the intermediate portion 162 of the pelvis belt 160 is entered into the belt installation groove 132, the finish plate 170 is inserted into the belt installation groove 132 over the intermediate portion 162 of the pelvis belt 160, to thus cover the belt installation groove 132. Engagement holes 172 formed of female screw lines are provided at positions corresponding to the piercing holes 164 of the pelvis belt 160 on the bottom of the finish plate 170. Therefore, bolts 174 are inserted into and engaged with bolt holes 134 of the bed 130, piercing holes 164 of the pelvis belt 160, and engagement holes 172 of the finish plate 170 in turn, from the lower portion of the bed 130. Accordingly, the pelvis belt 160 is rigidly fixed to the bed 130. Then, as shown in FIG. 5, the upper surface of the bed 130 and the upper surface of the finish plate 170 make a straight line and are connected to a single surface. In addition, both the side extensions 166*a* and 166*b* of the pelvis belt 160 withdrawn from the upper portion of the bed 130.

As described above, using the pelvis belt 160 combined with the bed 130, the hook and loop fasteners 168*a* and 168*b* of both the side extensions 166*a* and 166*b* of the pelvis belt 160 located at both sides of the waist are overlapped and attached to each other after a user has lain down on the bed 130, to thereby make the waist fixed to the bed 130. As the overlapped portion of the pelvis belt 160 becomes larger, the pelvis belt 160 tightens and presses the waist furthermore. As a result, a tensile effect of the lumbar can be additionally obtained. The pelvis belt 160 is basically made of a single belt of one fold as in this embodiment. However, the pelvis belt 160 may be formed of a double belt made up of two folds, which will be described below with reference to FIGS. 6 and 7.

Figure 6:
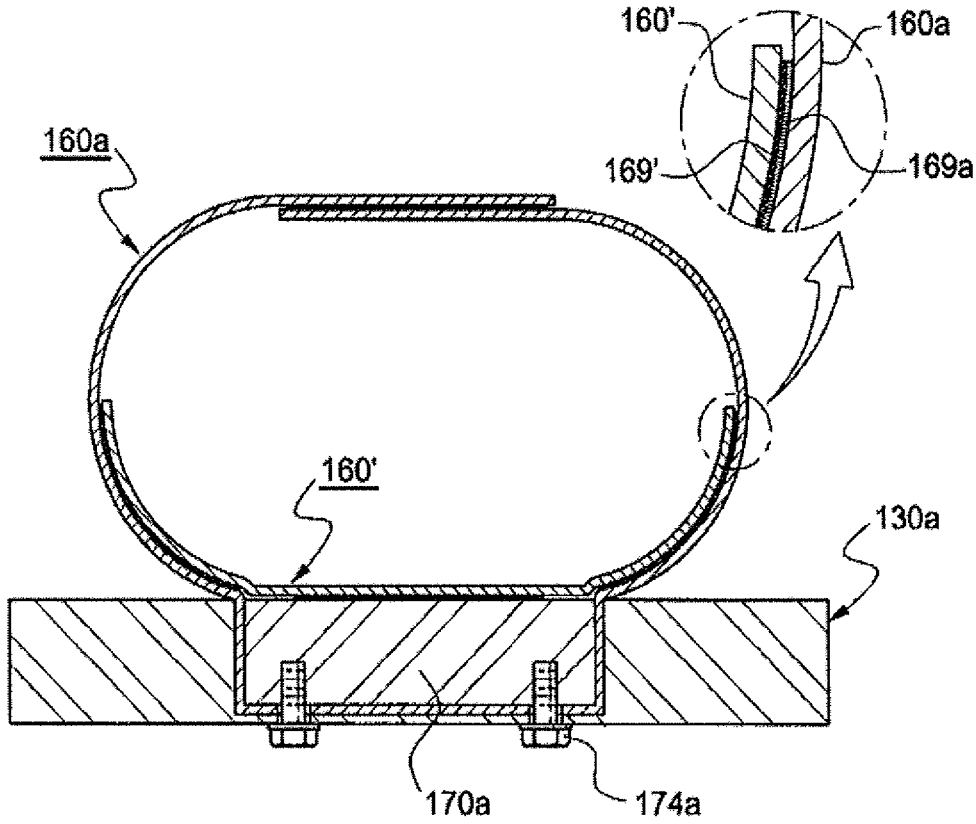
FIGS. 6 and 7 are cross-sectional view showing other embodiments of the belt illustrated in FIG. 5, respectively.
Figure 7:
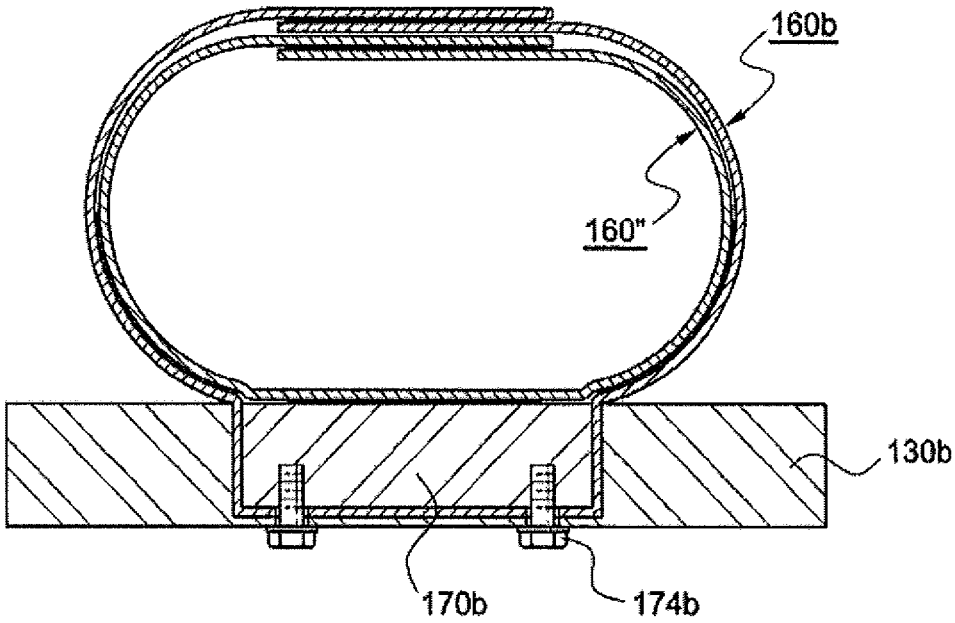

FIGS. 6 and 7 are cross-sectional view showing other embodiments of the belt illustrated in FIG. 5, respectively. In FIG. 6, only a part of the pelvis belt is formed of a double belt, and in FIG. 7 the whole part of the pelvis belt is formed of a double belt.

The pelvis belt may be configured to have an additional inner belt in addition to a basic belt (here, called an outer belt to discriminate from the inner belt) shown in FIG. 5. The inner belt 160' may be formed of a part style belt that wraps both side members of the waist, as shown in FIG. 6. In this case, hook and loop fasteners 169' and 169*a* are provided on the outer surface of both ends of the inner belt 160' and on the inner surface of the outer belt 160*a* corresponding to the inner belt 160' to then be combined with each other. Here, it may be efficient to attach the bottom of the inner belt 160' to the finish plate 170*a* of the bed 130*a*. For this reason, a hook and loop fasteners for sticking is provided on the finish plate 170*a* of the bed 130*a*.

Alternatively, the inner belt 160" may be formed of not a part style but a complete style as shown in FIG. 7. That is, the inner belt 160" is formed of a complete form as in the case of the outer belt 160*b*, but the bottom of the inner belt 160" is attached on the surface of the finish plate 170*b* and the both sides thereof are attached to the outer belt 160*b*. Both ends of the inner belt 160" overlap each other and are combined together between both ends of the outer belt 160*b*. Of course, hook and loop fasteners are provided at positions where two members are attached to each other, as in the former embodiment. Then, as illustrated in FIG. 7, at the state where the inner belt 160" wraps and fixes the user's waist perfectly once, the outer belt 160*b* wraps the inner belt 160" which has wrapped and fixed the user's waist perfectly again. Accordingly, a fixing power of fixing the waist to the bed 130*b* and a pressing power of the lumbar can double.

Alternatively, the pelvis belt may be configured into an air belt (not shown) into which air injected, in addition to the belt which is manufactured in an evenly flat form, and made of fiber, vinyl or leather illustrated in FIGS. 4 to 7. Preferably, the air belt into which air is locally injected into a portion corresponding to the both side surface regions of the waist can be used so that both the side surface regions of the waist (the flank) can be pressed more and more and seized to thereby enhance a traction effect. Concretely, air is injected into the air belt of about 15-25 cm upwards facing to the user's abdomen from the point where both the side extensions of the air belt are withdrawn from the bed, and then the air belt wraps both side portions of the waist thickly. As a result, cohesiveness can be enhanced and the pelvis is held effectively, to thus heighten a traction effect and improve a feeling of wearing the belt.

Furthermore, the pelvis belt is applicable if it is formed of a structure of holding the waist even if it is made of plastic or metal. The pelvis belt made of plastic or metal is widened in both sides and then the waist of a user who has lain down on the bed is located between the widened halves of the belt. Then, if the user presses manipulation buttons, the belt is automatically banded. As described above, in the case of plastic or metal belt, the belt wearing operation can be automated, but plastic or metal belt is not soft but stuff. A feeling of wearing the belt or cohesiveness may drop a little.

Figure 8:
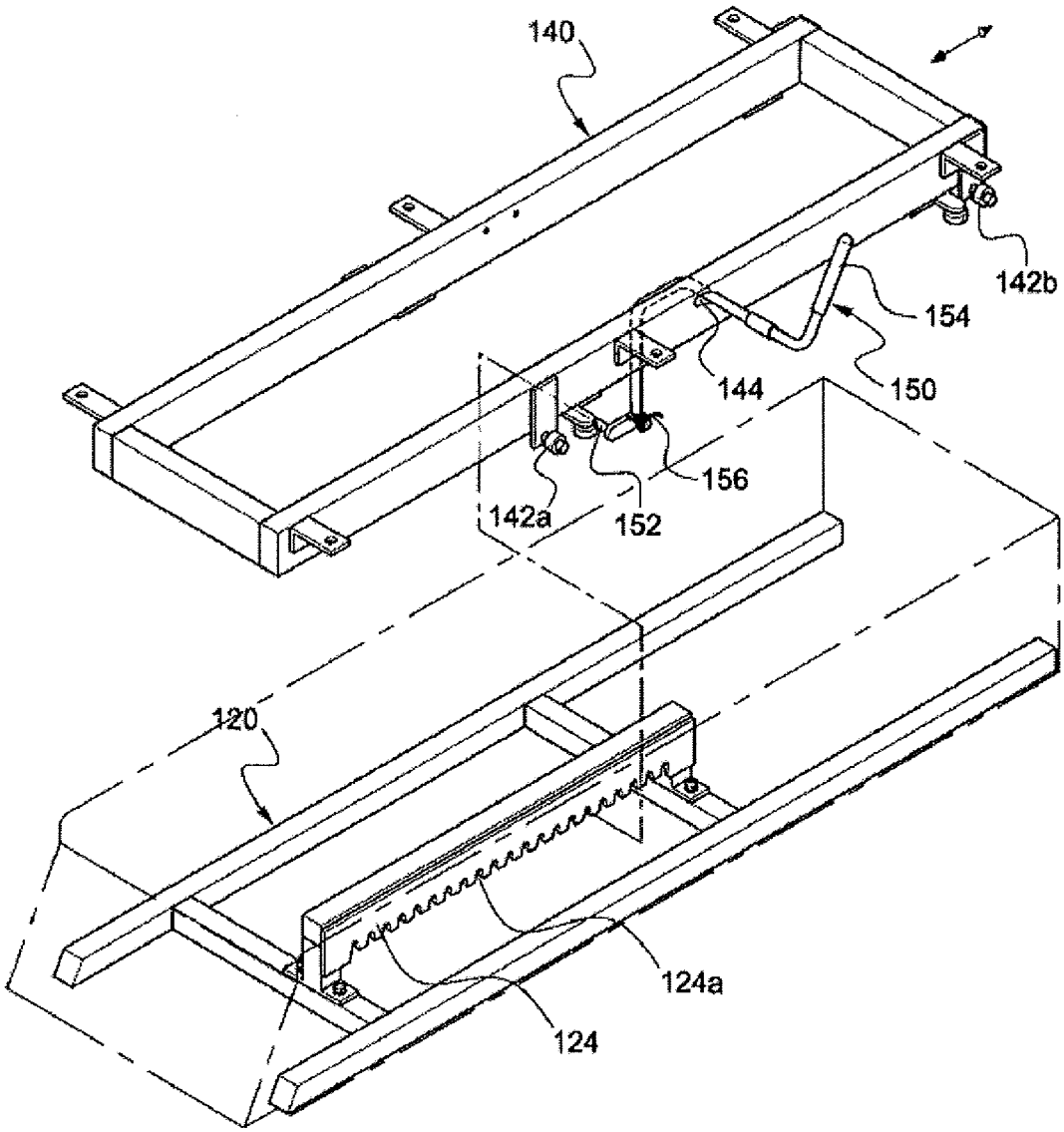
FIG. 8 is a perspective view showing a mechanism for controlling a distance between the bed and a user according to the present invention.
Figure 9:
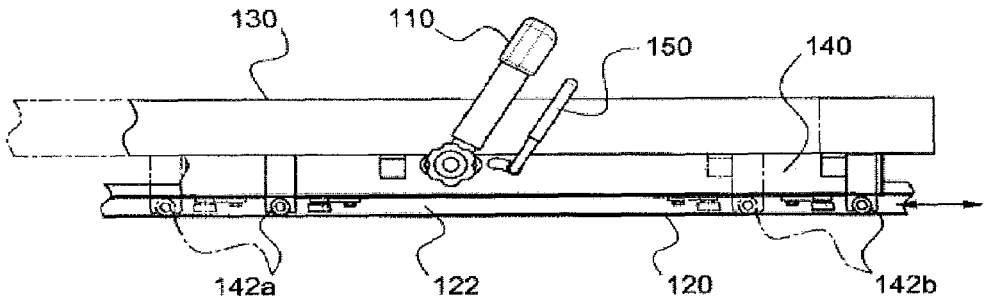
FIG. 9 is a detailed sectional view showing a portion at which the bed is slidably combined on the frame in FIG. 8.
Figure 10:
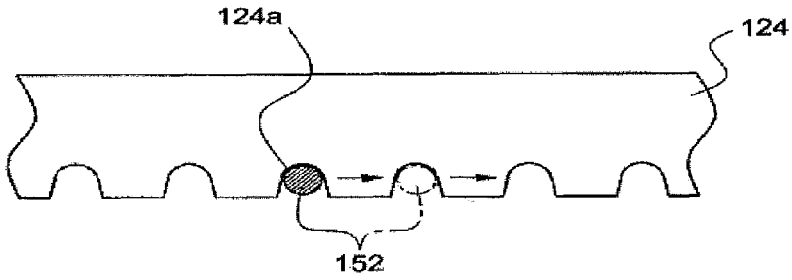
FIGS. 10 and 11 are schematic diagrams for describing a distance control method of the bed illustrated in FIG. 8.
Figure 11:
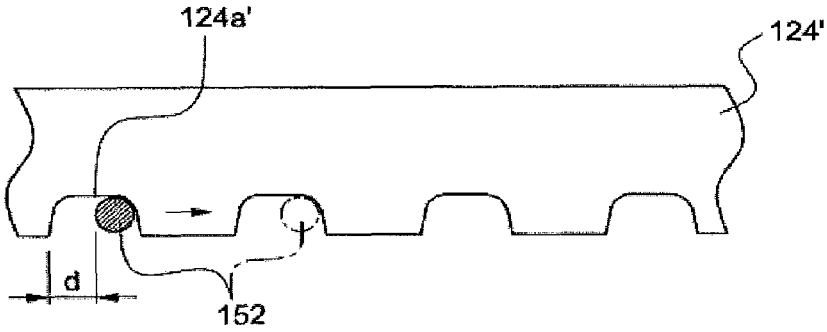

FIG. 8 is a perspective view showing a mechanism for controlling a distance between the bed and a user according to the present invention. FIG. 9 is a detailed sectional view showing a portion at which the bed is slidably combined on the frame in FIG. 8. FIGS. 10 and 11 are schematic diagrams for describing a distance control method of the bed illustrated in FIG. 8.

As explained before, this invention includes a bed movement mechanism that controls position of the bed 130 so that a user takes a more efficient exercise at a more comfortable state according to user's physical conditions. For this, in the case of a bed unit, a movable frame 140 on which a bed 139 is fixed is movably combined on a fixed frame 120 coupled with an exercise unit. That is, a pair of front rollers 142*a* and a pair of rear rollers 142*b* are installed at the left and right sides of the movable frame 140, respectively, and are slidably combined along a pair of guide rails 122 of the fixed frame 120. The backbone correction exercise apparatus according to the present invention includes a positioning unit in order to allow the movable frame 140 slid on the fixed frame 120, or maintain the movable frame 140 at the moved position.

As illustrated in FIG. 8, the positioning unit includes: a position control lever 150 which is provided in the movable frame 140; and a position setting plate 124 which is fixed to the fixed frame 120 in which locking grooves 124*a* which are engaged with movable portions 152 of the position control lever 150 are formed along the sliding direction of the movable frame 140. The position control lever 150 is entered into and penetrated into elongate hole 144 that is formed at one side of the movable frame 140 from a handle 154 located on the outside of the movable frame 140 in which the inner end of the position control lever 150 forms an operational portion 152 which is engaged with locking grooves 124*a* of the position setting plate 124, and the position control lever 150 is pivotably hinge-connected with the movable frame point 140 at a point in place. The position control lever 150 is pivoted around the point in place thereof with respect to the movable frame 140. Therefore, if the position control lever 150, for example, the handle 154 is pulled, the operational portion 152 which goes in gear to the locking grooves 124*a* departs from the locking grooves 124*a* and thus the movable frame 140 is movably released on the fixed frame 120. Reversely, if the movable frame 140 is made to move to then be adjusted, the movable frame 140 should be fixed at the adjusted position. For this, a restoration spring 156 is installed at the hinge-combined hinge shaft of the position control lever 150. Accordingly, if the pulled handle 154 is released, the operational portion 152 returns to an original state, so that the operational portion 152 is locked up with the relevant locking grooves 124*a*. As a result, the movable frame 140 is fixed at the moved position to the fixed frame to 120.

In this embodiment, the position control lever 150 is bent in the horizontal direction orthogonal with a sliding direction from the handle 154 which is located with a slope at the side of the movable frame 140. Then, the position control lever 150 penetrates through the elongate hole 144 formed at one side of the movable frame 140 and then bent again in the horizontal direction parallel with the sliding direction from the handle 154. Then, the position control lever 150 is bent in the vertical direction and then bent again in the sliding direction. The hinge shaft is formed at the point in place where the position control lever 150 is bent in the sliding direction. Thus, the restoration spring 156 is installed so as to be pivotably axially supported on the movable frame 140. In addition, the operational portion 152 is formed os that the position control lever 150 is bent again in the horizontal direction orthogonal with the sliding direction and engaged with the locking grooves 124*a*. As described above, in this embodiment, the position control lever 150 has a complex bent structure. However, the position control lever 150 may have a structure of being fixedly pivoted on the movable frame 140, so that the operational portion 152 can be engaged with or released from the locking grooves 124*a* if the handle 154 is made to rotate. The above-described complex bent structure can be changed in various forms to then be more simply implemented.

According to the above-described structure of the present invention, a method of controlling position of the bed according to user's physical conditions will be described below. If a user pulls the position control lever 150, the operational portion 152 of the position control lever 150 secedes from the locking grooves 124*a* of the position setting plate 124 with which the operational portion 152 is engaged. Thus, the movable frame 140 is released slidably from the fixed frame 120. In FIG. 9, if the bed 130 is made to move in this state, the rollers 142*a* and 142*b* of the movable frame 140 that is fixed to the bed 130 are slid along the guide rails 122 of the fixed frame 120 and the movable frame 140 moves on the fixed frame 120. Thus, as shown in FIG. 10, if the movable frame 140 combined with the bed 130 is made to move on the fixed frame 120, to then adjust position of the movable frame 140 into a desired position, and thereafter if the pulled position control lever 150 is set free, the operational portion 152 of the position control lever 150 goes in gear again with the locking grooves 124*a* at the moved position of the movable frame 140 and is fixed to the adjusted position.

Meanwhile, as shown in FIG. 11, if the locking grooves 124*a*' is enlarged greater than the operational portion 152 in a movement direction of the bed so that the operational portion 152 of the position control lever 150 can move at a predetermined interval at the state where the operational portion 152 of the position control lever 150 goes in gear to the locking grooves 124*a*' of the position setting plate 124' and thus a clearance "d" is given in the locking grooves 124*a*' in the bed movement direction, the upper body of the user may move due to a reaction depending upon operation of a cycling machine when the user who lies down on the bed makes his or her body with a pelvis belt and takes an exercise. In this case, the bed is made to naturally move together with the upper body of the user, to thus enlarge a tensile force such as a traction force which is applied to the backbone and thereby enhance a traction effect.

Figure 12:
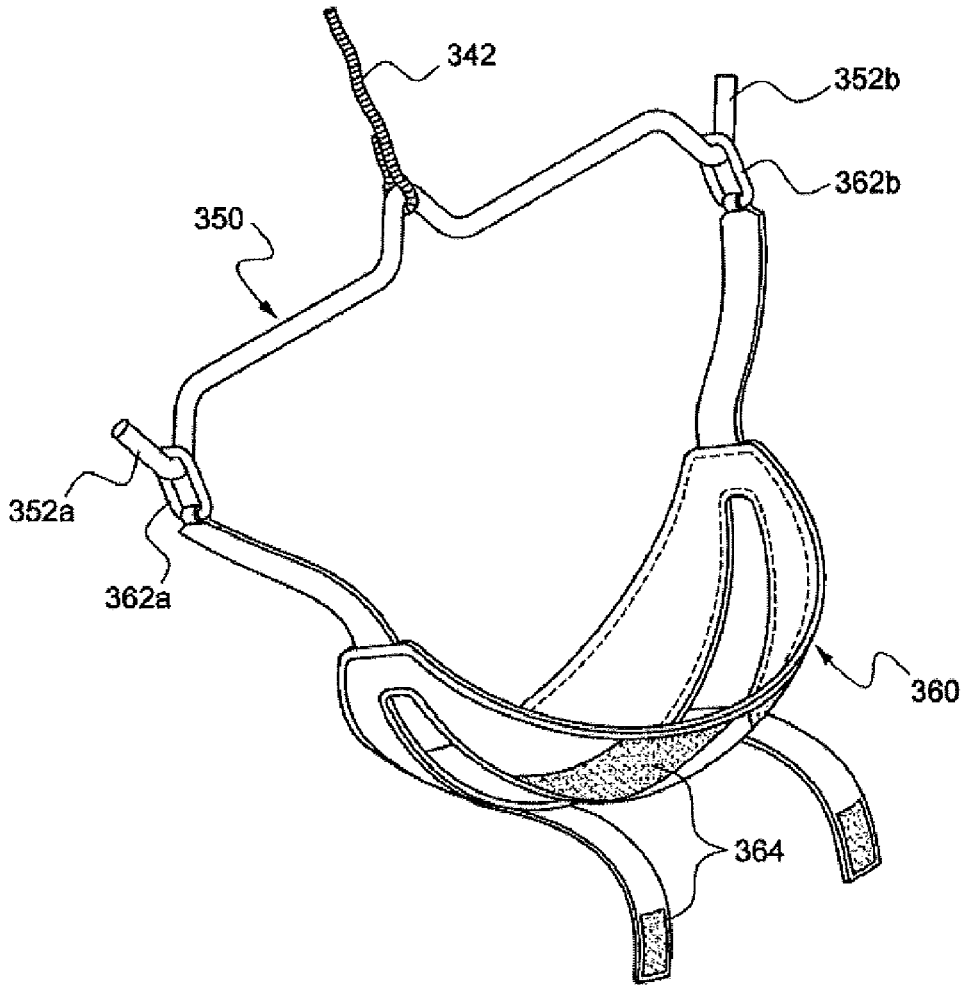
FIG. 12 is a perspective view showing structure of a cervical vertebrae traction unit according to the present invention.

FIG. 12 is a perspective view showing structure of a cervical vertebrae traction unit applied to the present invention. In particular, FIG. 12 shows structure of a cervical vertebrae traction bar 350 and a traction portion 360 forming the cervical vertebrae traction unit, in more detail. Referring to FIG. 12, a coupling structure of the cervical vertebrae traction bar 350 and the traction portion 360 and a method of using the same will be described below in detail.

First, a weight (that is, a load) is suspended from the cervical vertebrae traction bar 350 as described above. The cervical vertebrae traction bar 350 is bent in a substantially V-shaped form. A strap 342 at the end of which the weight is suspended is fixed at the center of the cervical vertebrae traction bar 350. In addition, locking hooks 352*a* and 352*b* are provided on both the ends of the cervical vertebrae traction bar 350. The locking rings 362*a* and 362*b* of the traction portion 360 are hung up with the locking hooks 352*a* and 352*b*, so that the traction portion 360 is combined with the cervical vertebrae traction bar 350. The traction portion 360 is worn on the user's head so that load of the weight is delivered to the user's head, and is made of soft and sturdy cloth. The traction portion 360 includes a portion which surrounds the user's head and portions which supports the user's chin and forehead which are linked with each other. Accordingly, the user's head can be firmly supported. In particular, portions at which the portion which surrounds the user's head and the portions which support the user's chin and forehead are connected with each other may be attached using hook and loop fasteners 364. As a result, the traction portion 360 can be easily put on and taken off from the user's head.

Figure 13:
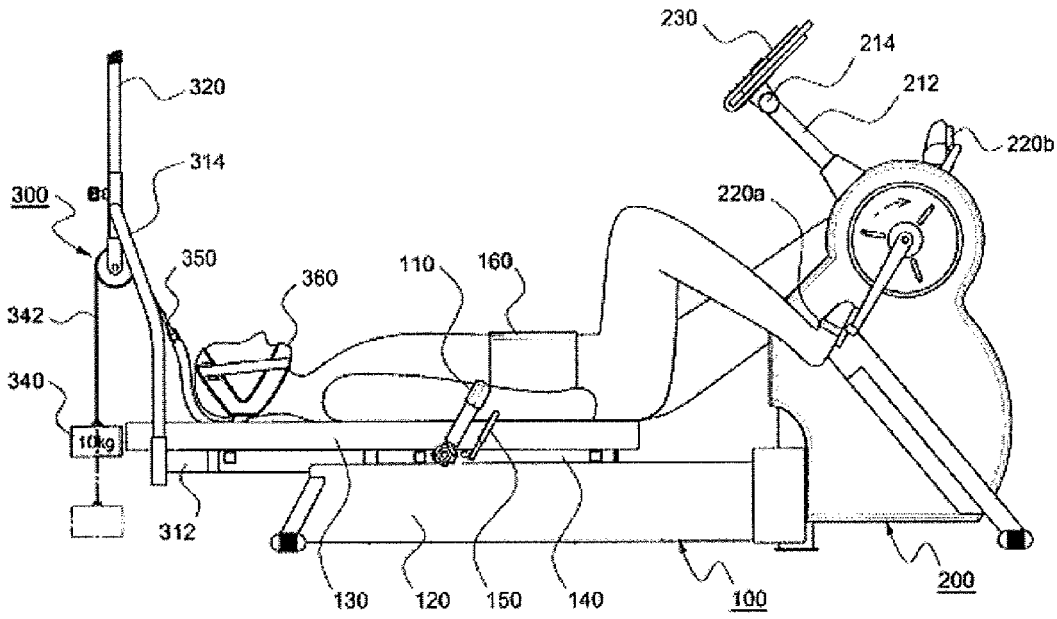
FIG. 13 is a side view showing a state of using a backbone correction exercise apparatus according to an embodiment of the present invention.

FIG. 13 is a side view showing a state of using a backbone correction exercise apparatus according to an embodiment of the present invention. Referring to FIGS. 1-13, the function and effect of the present invention will be described below in detail.

To use the backbone correction exercise apparatus according to the present invention, a user lies down on the bed 130 and judges whether or not distance between the exercise unit (for example, a cycling machine) 200 and the user is suitable. If it has been judged that the distance is not suitable, the bed 130 is made to move at the state where the position control lever 150 located beside the bed 130 has been pulled, to then be adjusted at a proper position. Then, the pelvis belt 160 is bound and fixed to the user's waist, in particular, the user's pelvis. Here, the pelvis belt 160 is tightened to press the user's waist, and then the hook and loop fasteners 168*a* and 168*b* of both the side extensions 166*a* and 166*b* of the pelvis belt 160 are attached to each other. Accordingly, a tensile effect of pulling and releasing the user's lumbar can be obtained. In addition, the traction portion 360 is hung up and connected with the cervical vertebrae traction bar 350 at the state where the user wears the traction portion 360 on the user's head. Before doing so, the weight 340 having a load which is appropriate for the user is suspended from the cervical vertebrae traction bar 350.

Then, the user's waist is fixed to the bed 130 by the pelvis belt 160 and the user's head is linked with the weight 340 through the traction portion 360. At this state, if the user fits the user's feet into the pedals 220*a* and 220*b* of the exercise unit 200, and steps on the pedal 220*a* and 220*b*, the user's upper body tries to move up by a reaction against the action of stepping on the pedal 220*a* and 220*b*. However, since the user's waist has been fastened by the pelvis belt 160, the user's backbone, especially the user's lumbar receives a force of trying to get unfolded to thereby have a traction effect. That is, since a direction of a force which is generated when the user pushes the pedal 220*a* and 220*b* with the user's feet and an opposite direction of a force which is generated due to the reaction against the action of stepping on the pedal 220*a* and 220*b*, mutually work at the state where the pelvis is fixed. As a result, a traction effect of towing away the user's waist is obtained. Further, the cervical vertebrae gets a tensile force which is pulled by an optimum weight 340, and is towed away.

In particular, the present invention enables a user to control the number of levels of the exercise unit, that is, the cycling machine, and to set an exercise degree suitable for the user, when making an exercise. Accordingly, the user can enjoy setting and making an exercise which does not burden on the user. At first, the user sets the exercise strength level to an easy or weak level and then makes an exercise of the easy or weak level. Thereafter, the user increases the exercise strength level gradually and makes an exercise of the increased exercise strength level. In this manner, the weak muscle can indurate gradually strongly effectively.

Therefore, the backbone correction exercise apparatus according to the present invention can tow away the cervical vertebrae as well as the lumbar vertebra, simultaneously or individually. Furthermore, since the tractive force acts on all the spinal parts, the backbone correction exercise apparatus according to the present invention is effective in a rehabilitation medical treatment for disk patients. In particular, disk or lumbago patients suffer from very big pain even in the case of making an exercise in a standing or sitting style, but since the backbone correction exercise apparatus according to the present invention enables a user to lie down on the bed and to make an exercises, pain can be minimized when making an exercise. Furthermore, the exercise of stepping on the pedals provides an effect of correction of the backbone of a patient whose pelvis twists or whose waist is bent. In addition, the pedaling exercise strengthens muscles of the waist connected with the backbone, for example, the backbone support muscles, etc., to thereby provide an effect of preventing and curing the backbone diseases. Furthermore, the exercise of stepping on the pedals makes a great effect of strengthening the abdominal muscles or the leg muscular power, as well as making a backbone exercise. Further, the pedaling exercise is an aerobic exercise, and is highly effective in view of a weight loss effect as well as for the purpose of strengthening a cardiopulmonary function, to thereby provide an excellent effect of preventing corpulence.

Figure 14:
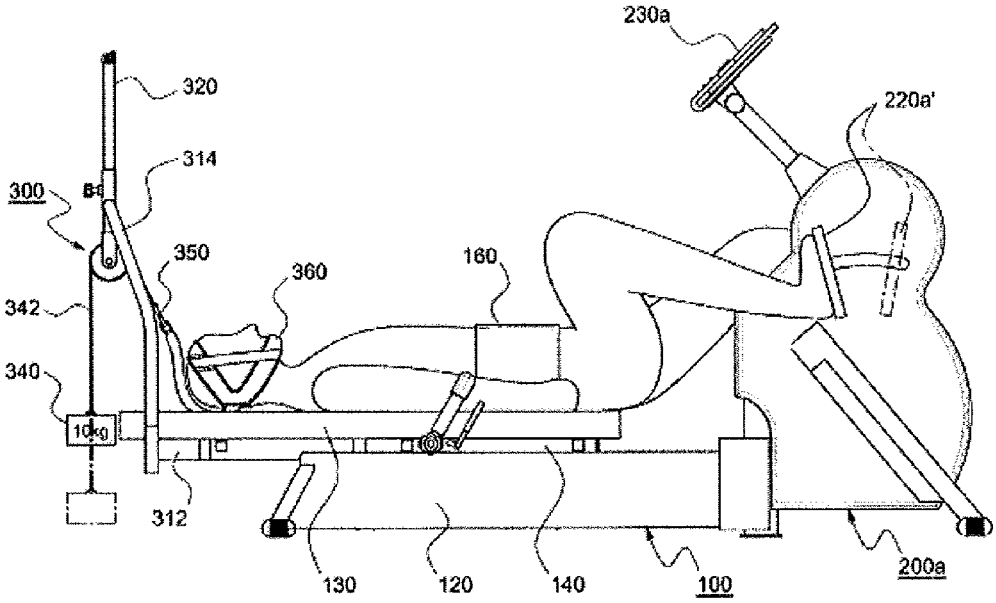
FIG. 14 is a side view showing a state of using a backbone correction exercise apparatus according to another embodiment of the present invention.

FIG. 14 is a side view showing a state of using a backbone correction exercise apparatus according to another embodiment of the present invention. In this embodiment, a stepper 200*a* is applied instead of the cycling machine of the previous embodiment. The other elements of this embodiment are same as those of the previous embodiment. Therefore, the method of using the backbone correction exercise apparatus according to this embodiment is same as that of the previous embodiment. However, since the stepper 200*a* is an implement which performs a linearly reciprocating movement differently from the cycling machine which performs a rotational movement using the pedal 220*a*', a user needs only a force of stepping down the stepper 200*a*. Accordingly, the stepper 200*a* can be suitable to a patient who is inappropriate in using the cycling machine, that is, a patient whose legs are unnatural in making an exercise.

Other exercise units that enable users to make an exercise with the legs may be applied to the exercise unit which is applied to the backbone correction exercise apparatus according to the present invention, in addition to the stepper or cycling machine. That is, a leg exercise unit which enables a user to sit down thereon and make an exercise may be slightly modified in its position or structure so as to enable the user to lie down thereon and make an exercise, and then the modified leg exercise unit may be combined with the bed unit which is applied in the backbone correction exercise apparatus according to the present invention. In this manner, almost all kinds of the leg exercise units may be easily in the backbone correction exercise apparatus according to the present invention. Therefore, the exercise unit is not limited to the above-described cycling machine or stepper.

Figure 15:
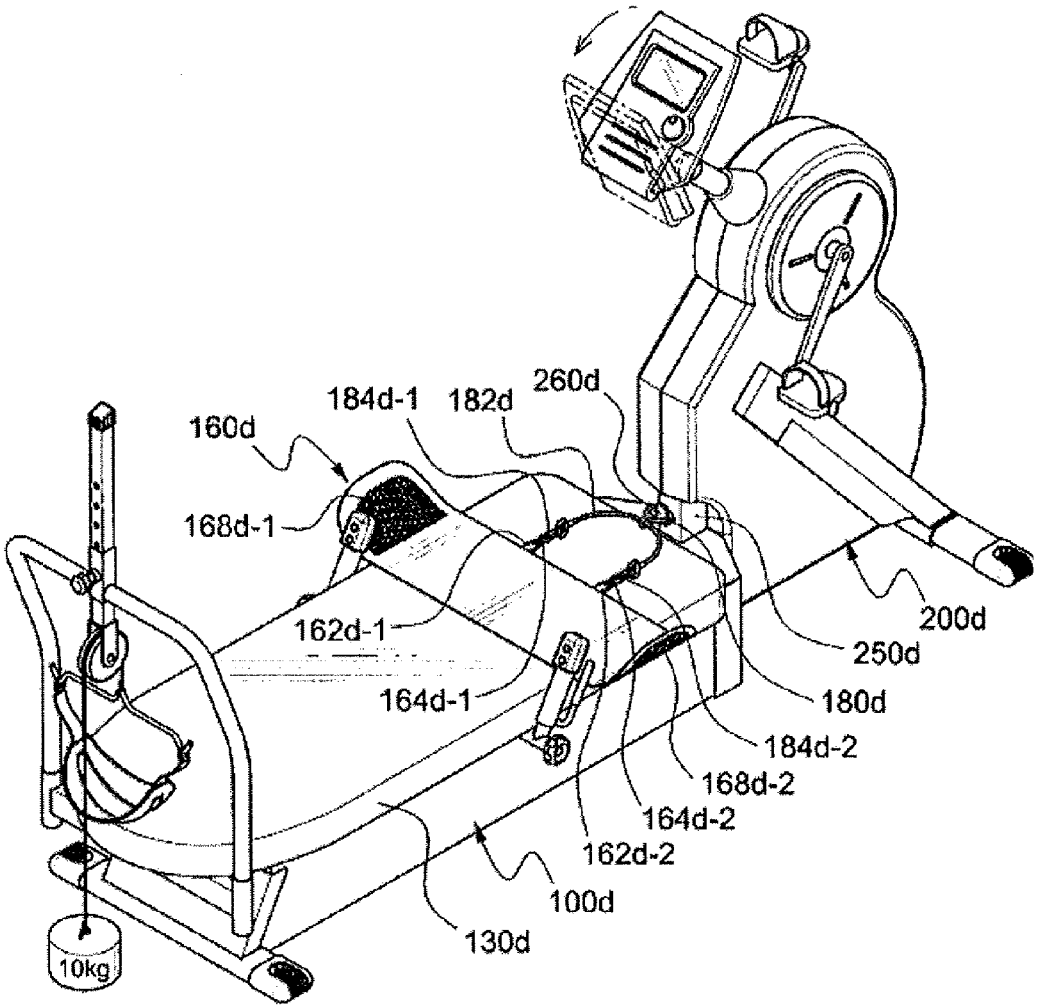
FIG. 15 is a perspective view showing a backbone correction exercise apparatus according to still another embodiment of the present invention.
Figure 16:
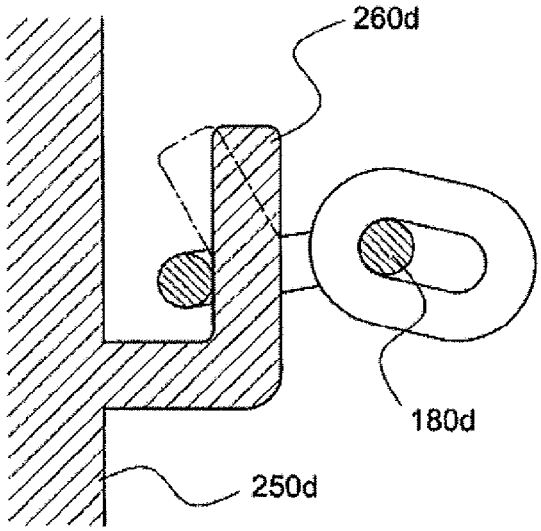
FIG. 16 is an extracted side cross-sectional view showing a ring coupling portion of FIG. 15.
Figure 17:
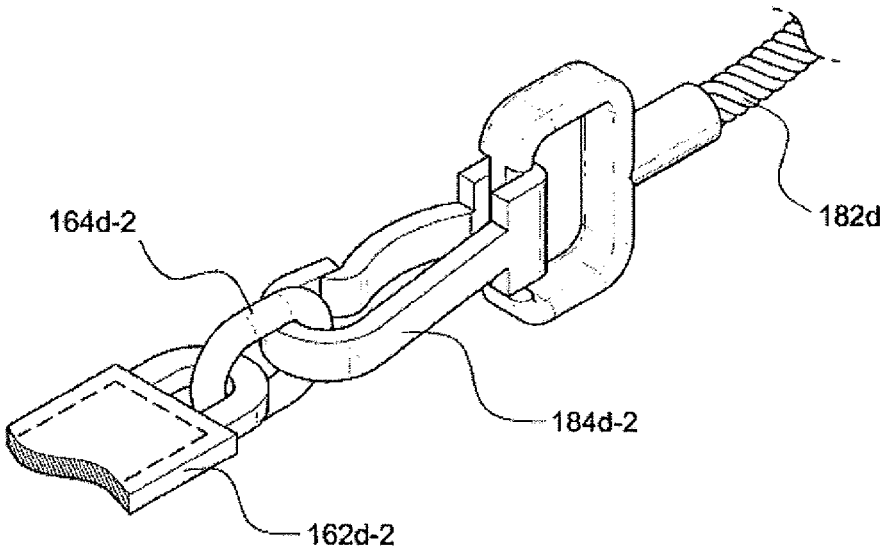
FIG. 17 is a partly extracted perspective view showing a ring coupling portion of FIG. 15, in detail.

Meanwhile, the pelvis belt may be configured to be easily and conveniently detached and attached using a ring coupling structure, without attaching the pelvis belt directly to the bed. This embodiment is illustrated in FIGS. 15 and 16. FIG. 15 is a perspective view showing a backbone correction exercise apparatus according to still another embodiment of the present invention. FIG. 16 is an extracted side cross-sectional view showing a ring coupling portion of FIG. 15. FIG. 17 is a partly extracted perspective view showing a ring coupling portion of FIG. 15, in detail.

In the case of the backbone correction exercise apparatus according to the present invention, a pelvis belt 160*d* may not be completely combined on the bed 130*d*, and independently separated from the bed 130*d*. That is, the pelvis belt 160*d* may be simply installed in the exercise unit using a ring 180*d* to then be used. After use, the pelvis belt 160*d* is separated from the bed 130*d* and kept in custody. That is, as shown in FIGS. 15 and 16, a ring hanger 260*d* is provided in a frame 250*d* of the exercise unit 200*d*, and then a ring 180*d* connected with the pelvis belt 160*d* is fitted into the ring hanger 260*d*, to accordingly achieve a simple coupling between the pelvis belt 160*d* and the exercise unit 200*d*. Concretely, it is preferable that the ring hanger 260*d* is protruded in an L-shaped form from the frame 250*d* of the exercise unit 200*d* near the bed 130*d*. It is preferable that the ring 180*d* of the pelvis belt 160*d* is connected to an elastic rope 182*d* and the elastic rope 182*d* is connected with the belt 160*d*, to thereby enable the pelvis belt 160*d* to be elastically extended and contracted when a user wears the pelvis belt on the pelvis and makes an exercise. In particular, more preferably, the upper end portion of the L-shaped ring hanger 260*d* is bent toward the frame 250*d* as shown as a one-dot-one-line in FIG. 16, to thereby prevent the ring 180*d* hung up with the ring hanger 260*d* from being easily seceded.

According to a method of combining the above-described elastic rope 182*d* and belt 160*d*, as illustrated in FIG. 17, coupling hooks 184*d*-1 and 184*d*-2 are fixed to both ends of the elastic rope 182*d* and a pair of connectors 162*d*-1 and 162*d*-2 are provided on the belt 160*d*. Coupling loops 164*d*-1 and 164*d*-2 are fixed to the connectors 162*d*-1 and 162*d*-2, respectively, and the coupling loops 164*d*-1 and 164*d*-2 are fitted into and coupled with the coupling hooks 184*d*-1 and 184*d*-2. Of course, as alternative positions of the coupling hooks 184*d*-1 and 184*d*-2 and the coupling loops 164*d*-1 and 164*d*-2, the coupling hooks 184*d*-1 and 184*d*-2 may be fixed to the connectors 162*d*-1 and 162*d*-2 of the belt 160*d*, respectively and the coupling loops 164*d*-1 and 164*d*-2 may be fixed to both ends of the elastic rope 182*d*, respectively.

Hook and loop fasteners (namely a sticker) 168*d*-1 and 168*d*-2 are attached to ends of both wings of the pelvis belt 160*d*. Accordingly, when the pelvis belt 160*d* is put on the waist, it is same as the previous embodiments to make both ends of the pelvis belt 160*d* overlapped one over the other by a predetermined portion of the pelvis belt 160*d*.

By this structure, in the case that the ring 180*d* of the pelvis belt 160*d* is fitted into the ring hanger 260*d* from the upward, the pelvis belt 160*d* is connected with the exercise unit. In the case that the ring 180*d* is lifted upward from the ring hanger 260*d* and taken out, the pelvis belt 160*d* is simply separated from the exercise unit.

In addition, since the pelvis belt 160*d* does not have a structure that the pelvis belt 160*d* is not linked with the bed 130, and is connected with the exercise unit 200*d* by an elastic rope 182*d* having a high elasticity, this embodiment is characterized in that the pelvis belt 160*d* can move to some degrees in the exercise direction with elasticity according to motion of the waist at an exercise time.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

As described above, the backbone correction exercise apparatus according to the present invention enables a patient to make a muscular power exercise by structure of an exercise unit such as a cycling machine or a stepper and a bed unit on which a pelvis belt is attached. By this muscular power exercise, a deformed backbone is recovered in a normal alignment, and a space between the vertebrae is widened, to thereby enable a user to set free from pain of a disk disease.

The backbone correction exercise apparatus according to the present invention enables a user to make an exercise at a lying posture, to thereby prevent patient's injuries. The backbone correction exercise apparatus according to the present invention is simple in its structure and small in its volume. Accordingly, the backbone correction exercise apparatus can be installed in a narrow space. In addition, the backbone correction exercise apparatus is relatively inexpensive and thus has an advantage of suppling an opportunity of making an exercise for patients as many as possible through mass-production and mass-distribution. As a result, user's economic burden can be reduced, and the backbone correction exercise apparatus can be conveniently installed in spaces such as offices or bedrooms.

The backbone correction exercise apparatus according to the present invention can correct incorrect positions of the deformed pelvis in sports facilities, hospitals or homes by a relative simple structure and direction of use. Accordingly, causes bringing down the backbone pain may be removed. As well, the chronical lumbago, gout by disk and other backbone diseases may be cured.

The backbone correction exercise apparatus according to the present invention can recover the deformed backbone (vertebra) which secedes when vertebrae forming the backbone are widened, to thereby correct the backbone and to thus enable a patient to lie down thereon without applying a load onto the patient's waist and decompose body fat of the waist portion through an aerobic exercise to thus provide an effect of removing corpulence.

According to this invention, an interval between the lumbar and the lumbar can be widened. As well, muscles can be strengthened. Accordingly, disk diseases can be effectively cured. In particular, the bed can be adjusted according to user's physical conditions, and the bed can be slid by a predetermined distance when making an exercise. Accordingly, an exercise effect and a backbone correction capability may double. Further, a head traction portion is provided to thus enhance a correction effect of the cervical vertebrae or neck bone.

As described above, the present invention provides a backbone correction exercise apparatus, in which a user lies on a bed and wears a pelvis belt, adjusts distance from an exercise unit depending on a user's physical condition, and then performs recursive exercises, to thereby slack and restore the cervical vertebra portion and the lumbar vertebra portion of the human body repeatedly and to thus strengthen spinal peripheral support muscles in order to provide a spinal curative effect as well as a spinal exercise effect.

What is claimed is:

1. A backbone correction exercise apparatus comprising:

an exercise unit which enables a user to lie on a bed and perform an exercise using the user's feet, said unit is at least one of a cycling machine or a stepper machine including a pair of pedals into which both feet of the user are fitted from both sides of a body of the exercise unit;

a pelvis belt having an intermediate portion fixed to said bed, belt side extensions extending from the intermediate portion rise up from the bed and wrap and hold a portion of a user corresponding to the waist of the user, a binding unit provided in the ends of the extensions for affixing the user to the bed by binding said ends of said side extensions; and a bed unit is combined with said exercise unit whereby a distance between the exercise unit and the user is controlled, wherein a belt installation groove is formed on the bed, said belt installation groove is covered with a finish plate at a location where the intermediate portion of the pelvis belt enters the belt installation groove, thus making the surface of the bed flat, and wherein the bed, the pelvis belt and the finish plate are secured by together bolts.

2. The backbone correction exercise apparatus according to claim 1, further comprising a positioning unit which allows the bed to move or remain stationary.

3. A backbone correction exercise apparatus comprising:

an exercise unit which enables a user to lie on a bed and perform an exercise using the user's feet, said unit is at least one of a cycling machine or a stepper machine including a pair of pedals into which both feet of the user are fitted from both sides of a body of the exercise unit;

a bed unit comprising a movable frame slidably combined on a fixed frame;

the bed fixed on the movable frame; and a pelvis belt having an intermediate portion fixed to said bed, belt side extensions extending from the intermediate portion rise up from the bed and wrap and hold a portion of a user corresponding to the waist of the user, a binding unit provided in the ends of the extensions whereby the bed moves along the bed unit so that distance between the exercise unit and the user is controlled; and a positioning unit attached within the fixed frame and the movable frame for allowing the movable frame to move or maintained at the moved state, wherein a belt installation groove is formed on the bed, said belt installation groove is covered with a finish plate at a location where the intermediate portion of the pelvis belt enters the belt installation groove, thus making the surface of the bed flat, and wherein the bed, the pelvis belt and the finish plate are secured by together bolts.

4. The backbone correction exercise apparatus according to claim 1 or 3, wherein the binding unit is a hook and loop fastener.

5. The backbone correction exercise apparatus according to claim 1 or 3, wherein said pelvis belt is an air belt in which air is injected into a portion corresponding to side portions of the user's waist.

6. The backbone correction exercise apparatus according to claim 3, wherein a pair of front rollers and a pair of rear rollers are installed at left and right sides of the movable frame, respectively, and a pair of guide rails along which the rollers travel are provided in the fixed frame at left and right sides thereof, respectively.

7. The backbone correction exercise apparatus according to claim 3 or 6, wherein the positioning unit comprises:

a position control lever provided at a side of the movable frame; and a position setting plate fixed to the fixed frame in which locking grooves which are engaged with movable portions of the position control lever are formed along the sliding direction of the movable frame.

8. The backbone correction exercise apparatus according to claim 7, wherein the position control lever is fixed to the movable frame and pivotable around a hinge shaft, and an elastic spring is installed at the hinge shaft, wherein:

when the position control lever is pulled, the position control lever is pivoted around the hinge shaft to make the movable portions of the position control lever secede from the locking grooves and to make the movable frame released from the fixed state, and to thereby allow the movable frame to move, and when the position control lever is set free, the position control lever is returned such that the movable portions of the position control lever are engaged with the locking grooves.

9. The backbone correction exercise apparatus according to claim 7, wherein the locking grooves have a clearance, respectively, such that the movable portions of the position control lever can move by a predetermined distance.

10. The backbone correction exercise apparatus according to claim 1 or 3, further comprising a cervical vertebrae traction installed at an end of the bed where the user's head is positioned, said cervical vertebrate traction being configured to apply a load to the head of a user so as to pull the cervical vertebrae of the user on the bed.

11. The backbone correction exercise apparatus according to claim 10, wherein the cervical vertebrae traction unit comprises:

a mount portion combined with the end of the bed unit;

a vertical movement rod combined with the mount portion and having a controllable height;

a weight and a cervical vertebrae traction bar connected by a strap wound on a pulley rotatably combined with the vertical movement rod; and a traction portion connected with the cervical vertebrae traction bar and which is worn on the user's head to thus transfer the load of the weight to the head.

12. The backbone correction exercise apparatus according to claim 1 or 3, further comprising a remote controller that allows the user to set an exercise condition such as an exercise type and an exercise strength provided at the side of the bed unit, and a display panel whose angle is adjusted provided in the exercise unit, the display panel displaying the state controlled by the remote controller.

* * * * *